US005485139A

United States Patent [19]

Tarnovsky

[11] Patent Number: 5,485,139

[45] Date of Patent: Jan. 16, 1996

[54] TALKING DISPLAY SIGNAGE

[76] Inventor: Goerge V. Tarnovsky, 402 Riley Rd., New Windsor, N.Y. 12553

[21] Appl. No.: 412,059

[22] Filed: Mar. 28, 1995

Related U.S. Application Data

[63] Continuation of Ser. No. 129,346, Sep. 30, 1993, abandoned.

[51] Int. Cl.[6] ..... G08B 23/00

[52] U.S. Cl. ..... 340/573; 340/555; 340/692; 359/155; 364/554

[58] Field of Search ..... 340/573, 555–557, 340/552–554, 692, 825.35; 367/93–94; 250/221, 222.1; 364/554; 359/155; 342/118; 356/3

[56] References Cited

U.S. PATENT DOCUMENTS

| | | | |
|---|---|---|---|
| 4,166,273 | 8/1979 | Riley, Jr. et al. | 340/552 X |
| 4,338,594 | 7/1982 | Holm | 340/556 X |
| 4,512,000 | 4/1985 | Masuko | 340/552 X |
| 4,670,798 | 6/1987 | Campbell et al. | 360/12 |
| 5,264,822 | 11/1993 | Vogelman et al. | 340/692 X |
| 5,295,064 | 3/1994 | Malec et al. | 340/825.35 |

*Primary Examiner*—Thomas Mullen
*Attorney, Agent, or Firm*—Joseph L. Spiegel

[57] ABSTRACT

A system for presenting automatic verbal announcement by means of active infrared detection in conjunction with a digital voice recorder/playback unit includes a modulated infrared signal generator for generating a signal of given frequency at a target when in a sensing range, a detector for detecting a modulated infrared signal of the given frequency reflected from a target within the sensing range, a digital voice recorder/playback unit for recording and then providing announcements, when a target is within the sensing range, a speaker to provide an audible output from a signal generated by the digital unit and a microprocessor operatively connected to the generator to periodically output a modulated signal from the generator, to the detector for receiving a signal of the given frequency when a target is within the sensing range and to the digital unit for sending a signal to same and initiate an announcement when a signal is received from the detector. Various switches are provided to allow for different modes of operation. The system also provides for the taking of statistical data.

4 Claims, 4 Drawing Sheets

TALKING DISPLAY SIGNAGE

CROSS REFERENCE TO RELATED APPLICATION

This application is a continuation of my application Ser. No. 08/129,346 filed Sept. 30, 1993.

BACKGROUND OF THE INVENTION

1. Field of the Invention

The invention relates to talking display signage, more particularly a display system that offers verbal annunciation utilizing digital record/playback with active infrared detection so as to interact with any target within a sensing range, as well as collection of statistical data during announcements.

2. Description of the Prior Art

Typically past devices used for similar purposes utilize passive detection systems. Hart, U.S. Pat. No. 4,930,236, and Hoshi, U.S. Pat. No. 4,934,079, disclose passive infrared detection devices, while Wu, U.S. Pat. No. 5,003,293 utilizes a heat radiation sensing element. The major disadvantage to these past inventions is that they require the target to emit or block energy, causing a change in energy to be detected by the sensor. This is known as passive detection. If the temperature of the target is the same as the ambient, no change in energy is detectable, such as in the case of a car fender, cat, bicycle, carriage, a heavily clothed person, or if the target enters the sensing area slowly. Since these devices sense a rate of change in energy within the viewing field, there would be no detection of the target. Carter, U.S. Pat. No. 3,088,996, uses available visible light optical interruption as a detection technique. This requires available visible light as a source to be interrupted by the target. This method is susceptible to variations in ambient light levels.

SUMMARY OF THE INVENTION

This system is used for automatic verbal annunciation to interact with persons, cars, or any target, even paper, by means of an active infrared detection system in conjunction with digital voice record/playback, storing announcements in battery-backup ram memory. This system may be used for the purpose of advertising, warning, and general automatic verbal annunciation. When a target is within a sensing range, so as to reflect the modulated infrared signal being emitted by this device, the detector senses this reflected signal. After conditioning and filtering this signal, a microprocessor initiates a verbal announcement to be played over a speaker by the digital voice record/playback unit. If the target leaves the sensing range of the device prior to the completion of the announcement, the device may either continue, terminate, or begin a parting announcement. If the target remains within sensing range to the end of the announcement, the device may wait a predetermined length of time before starting the sequence over. A count of the number of targets entering the sensing range and the length of time within the sensing range are stored for output to a printer, terminal, computer, modem, or display for the purpose of statistical reporting.

Announcements are placed into battery-backup ram memory by means of either a microphone, tape loader unit, or any audio source. Once the announcements are recorded into memory, the system may be placed into operation. The sensing range and the volume may be adjusted for the appropriate operating distance and environment. The system will periodically emit a modulated infrared beam while sensing for a reflected signal to arrive at the sensor. If a reflected signal is detected, the system will begin a verbal announcement. While the announcement is being played, the system will continue to sense, looking to see if the target has left the sensing area. If so, and depending on the mode selected, the device will either terminate or begin a parting announcement. On the other hand, if the target remains in the sensing area for the duration of the entire announcement, the system will be idle, waiting for the target to leave the area. If the target remains within the sensing area for a predetermined waiting period, the announcement will begin again and the entire sequence will repeat.

Accordingly, an object of this invention is to provide an automatic verbal annunciation system utilizing active infrared detection system in conjunction with digital voice record/playback unit for the purpose of advertising, warning, and informing.

Another object is such a system that will allow taking of statistical data such as number of targets that were detected and duration of stay within the target range for future statistical analysis to be retrieved by printer, computer, modem, display, etc.

BRIEF DESCRIPTION OF THE DRAWING

These and other objects, features, and advantages of the invention will become apparent from a consideration of the following specification when considered with the appended drawing wherein.

DETAILED DESCRIPTION

Figure 1:
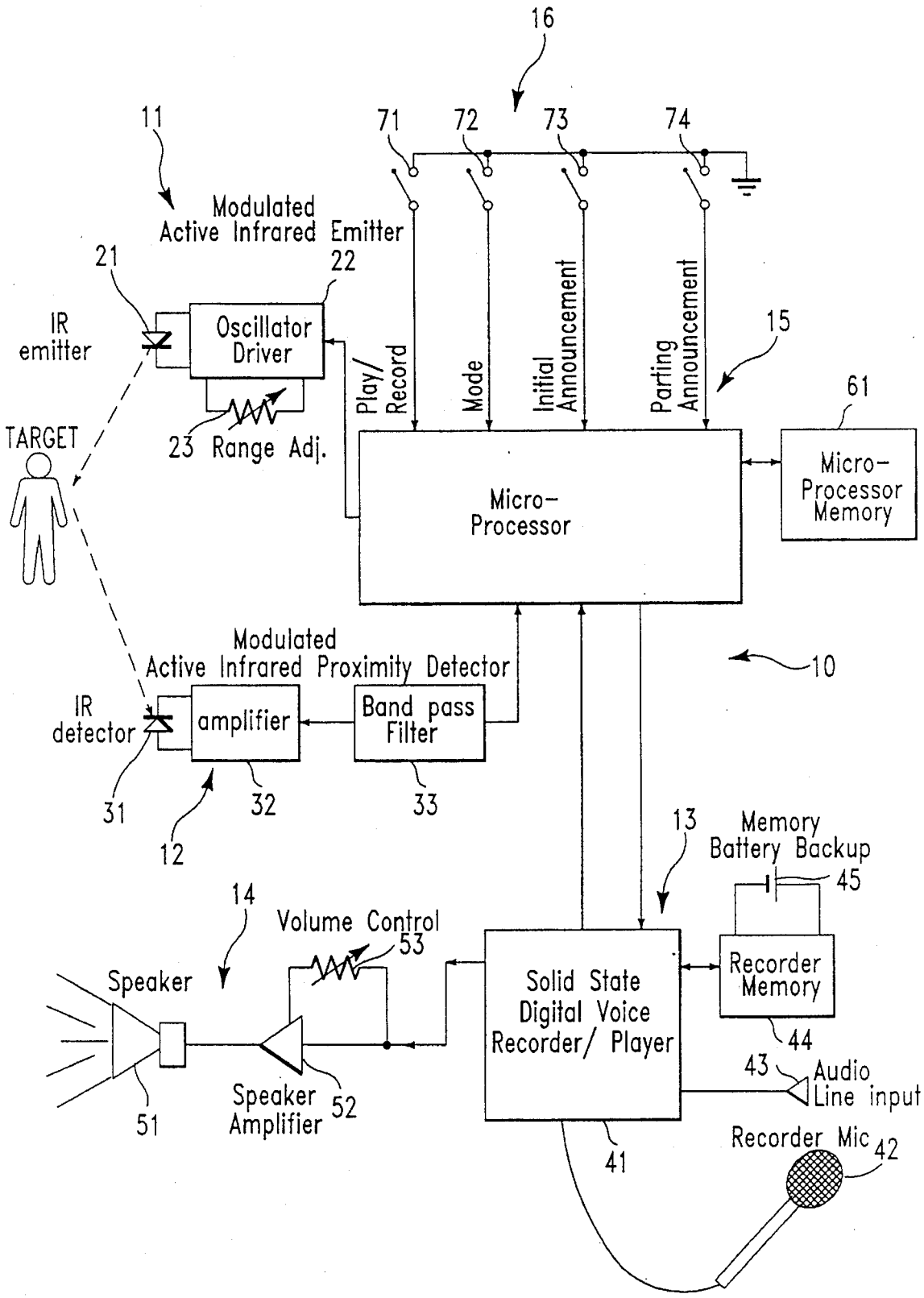
FIG. 1 is a block diagram of a preferred embodiment of the invention showing a system for presenting automatic verbal announcements by means of active infrared detection in conjunction with digital voice record/playback means.

Referring now to FIG. 1, there is disclosed a preferred system 10 for presenting automated verbal announcements by means of active infrared detection in conjunction with a digital voice record/playback unit.

The system 10 is shown as including: a modulated active infrared signal generator 11; a modulated infrared signal detector 12; recorder/playback means 13; speaker means 14; and, a microprocessor 15 with associated switching means 16.

Infrared signal generator 11 is included to generate a modulated infrared signal of a given frequency say 38 KHZ at a target when the target comes within the sensing range of the detector 12.

Generator 11 includes an infrared emitter 21, an oscillator/driver 22 for generating the signal and potentiometer means 23 to vary the output level of the generator 11 so as to vary the sensing range of the system 10.

Detector 12 comprises an infrared detector 31 for receiving a signal (reflected from the target when within the sensing range), amplifier 32 for conditioning the signal and a band pass filter 33 for passing through a signal of the given frequency.

The system 10 further includes a digital voice recorder/playback means 13. The means 13, when in a recording mode, will permit recording of an initial announcement and a parting announcement, and when in a playback mode, will play an announcement via the speaker means 14 to be described hereafter when a target is or has been present within the sensing range.

The recorder/playback means 13 includes a solid state digital voice recorder/player unit 41, a microphone 42, an audio input line 43, or both, for providing an audio signal to unit 41, when in a recording mode, and a ram memory 44 with battery back-up 45 for storing the announcements.

In the playback mode, unit 41 will provide a signal to speaker means 14. Speaker means 14 typically includes speaker 51, amplifier 52 and volume control 53.

Control of the system 10 is via a microprocessor 15, including microprocessor memory 61 operatively connected to the signal generator 11, detector 12 and record/playback means 13.

Finally, the system 10 includes a switching means 16 including play/record switch 71, mode switch 72, initial announcement switch 73 and parting announcement switch 74, and connected to microprocessor 15 and operative in the hereafter described manner.

Before use commences, announcements must first be recorded and stored in memory 44. To record an announcement, switch 71 is placed in the record position. Using microphone 42 or audio line input 43 from a tape, audio amplifier and the like, activating switch 73 or switch 74, depending on which announcement will be recorded, will start the recording function. At this time the operator must supply the dialog either by speaking into microphone 42, or by supplying an audio source via input 43. Once the dialogue is completed, pressing the switch 73 or 74 initially activated will terminate the recording session. Returning switch 71 to the playback position will ready the device for use.

The announcements may then be tested by activating switch 73 or 74 depending on which announcement the operator would like to test.

The mode switch 72 selects one of two operating modes. Mode one terminates an announcement when a target leaves the sensing range and begins the parting announcement. Mode two continues the initial announcement until completed before starting the parting announcement.

In use, mode switch 72 will be in open position. Microprocessor 15 enables the oscillator/driver 22 and a modulated infrared beam is emitted from emitter 21 within a given sensing range. The sensing range can be adjusted via potentiometer means 23, by varying the output of the emitter 21.

When a target enters the sensing range it will reflect the signal generated. When the signal is reflected to a high enough level, it will be received by detector 31. If the received signal is of the same frequency as that of the signal from emitter 21, it will pass through band pass filter 33 allowing microprocessor 15 to determine the presence of a target.

If target is adequate in duration and distance microprocessor 15 will send a start signal to playback unit 41 initiating an initial announcement.

When the target remains within the sensing range for the duration of the initial announcement, microprocessor 15 will have received a signal from the digital voice recorder 41 that the initial announcement has finished. At this time microprocessor 15 may initiate the parting announcement. If a target remains within the sensing range the entire cycle microprocessor 15 will wait a predetermined length of time and start the entire sequence over again.

Alternatively, if the target leaves the sensing range prior to completion of the initial announcement, microprocessor 15 will send a stop command to playback unit 41. This action will terminate the initial announcement and initiate playback of the parting announcement, after which the system will go idle, waiting for another target to enter its sensing range. If mode switch 72 is closed when the target leaves the sensing range prior to completion of the initial announcement, the initial announcement will continue to play to the end.

Figure 2:
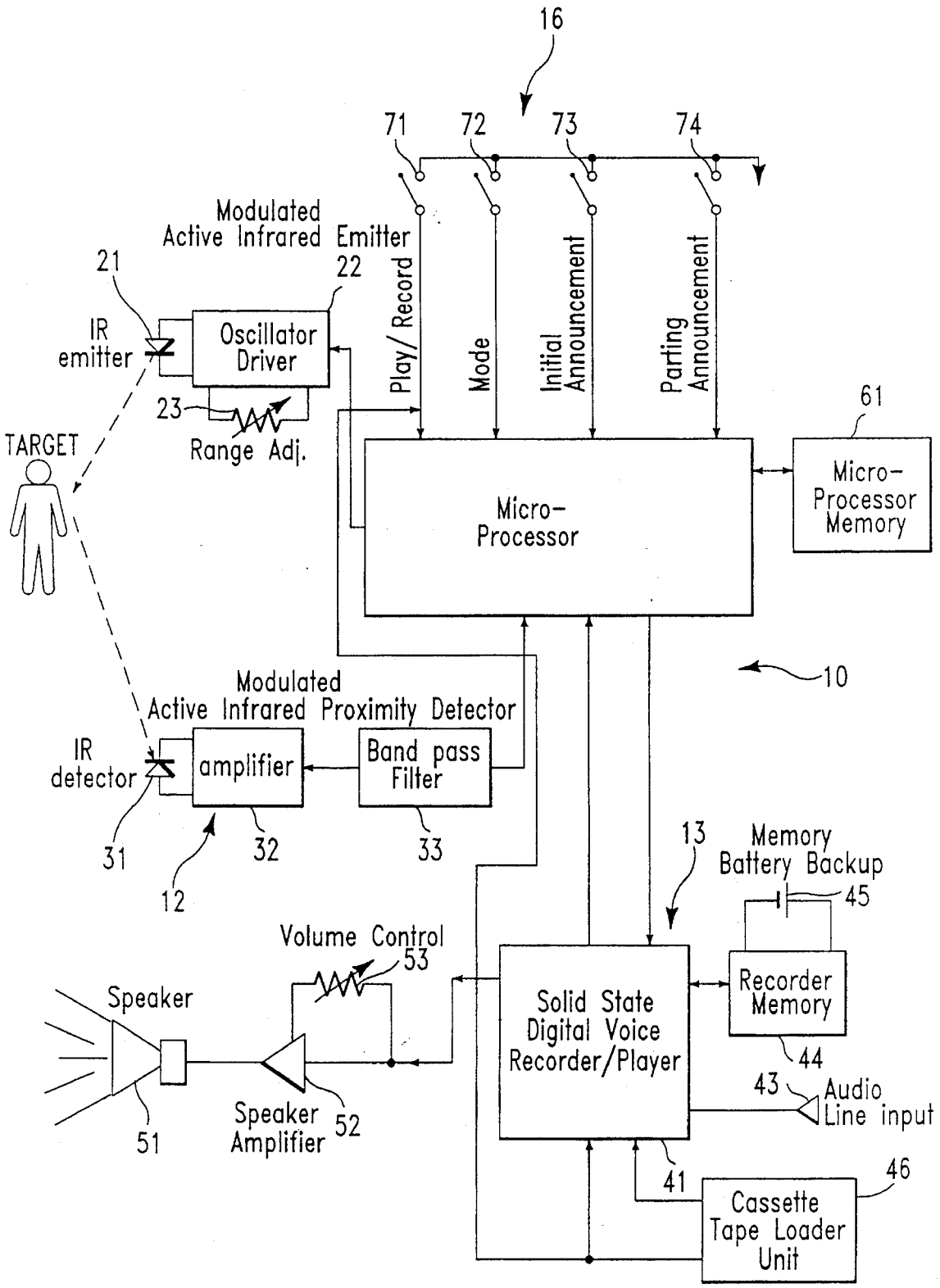
FIG. 2 is a block diagram of another embodiment of the invention using a cassette tape loader unit rather than a microphone for audio input during recording.

Referring now to FIG. 2 wherein like numerals refer to like parts a cassette tape loader unit 46 is utilized rather than a microphone for audio input during recording. In this case the audio source for recording comes from tape loader 46. The tape loader unit 46 works in conjunction with microprocessor 15. When the tape loader unit 46 is placed into playback, it will automatically place the digital voice recorder unit 41 into record. At this time the tape loader unit 46 will prompt the operator via a beep tone through speaker 51 to press the initial announcement switch 73 or the parting announcement switch 74, depending upon which announcement is to be loaded. After the dialog is over, the operator must press the initial announcement switch 73 or the parting announcement switch 74 to signal the end of the recording. Additionally, stopping the tape loader 46 will place the device into playback and the system is now ready for the next target to enter the sensing range. Testing the recorded announcements is accomplished by pressing the initial announcement switch 73 or the parting announcement switch 74, depending upon which announcement the operator would like to test.

Figure 3:
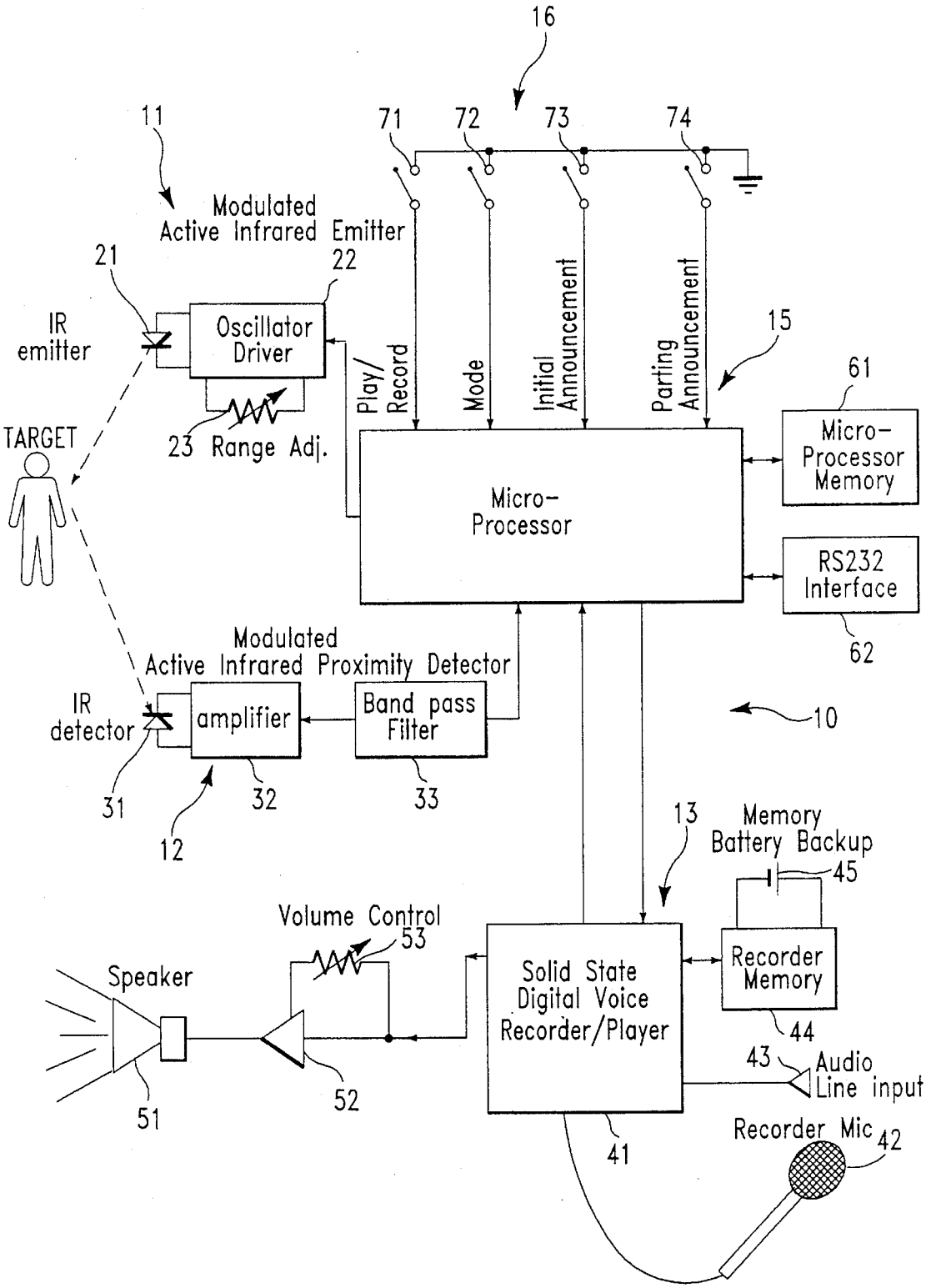
FIG. 3 is an embodiment similar to that of FIG. 1 but with the addition of an RS232 interface for gathering statistical data; and, FIG. 4 is a view similar to the embodiment of FIG. 2 but again with the RS232 interface for gathering statistical data.
Figure 4:
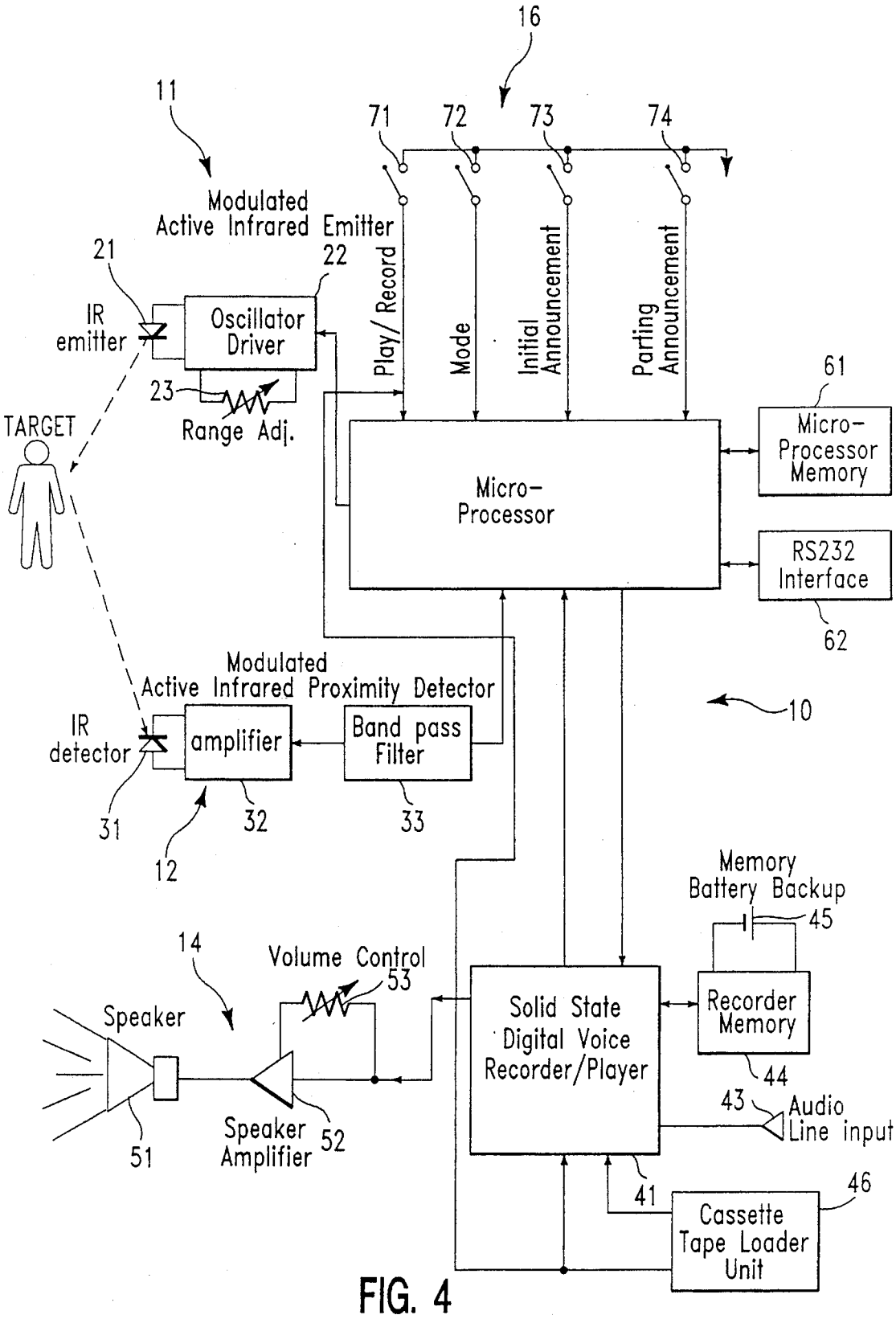

The embodiment in FIG. 3 of the drawing is similar to FIG. 1 and the embodiment depicted in FIG. 4 is similar to FIG. 2 with the exception of the addition of an RS232 interface 62. During the sensing of a target, statistical data may be gathered for future statistical analysis such as the number of targets entering the sensing range, the duration they remain within the sensing range and the time/date stamping may all be recorded in the memory 61, to be retrieved from the interface 62 such as via printer, terminal, computer, modem, or display (not shown) for statistical reporting.

It will be appreciated by those skilled in the art that the above-described embodiments are simply illustrative of the application of the principles of the invention and that numerous other changes and omissions may be readily devised by those skilled in the art which fall within the spirit and scope of the invention.

What is claimed is:

1. A system for presenting automatic verbal announcements comprising:

a modulated infrared signal generator for generating a modulated signal of given frequency at a target when the target is within a sensing range;

a detector for detecting a modulated infrared signal of the given frequency after is it reflected from a target within the sensing range;

a digital voice recorder/playback means for recording an announcement and subsequently providing said announcement when a target is within the sensing range;

speaker means to provide an audible output in response to the announcement received from said digital voice recorder/playback means; and, a microprocessor operatively connected to said generator to periodically output a modulated signal from said generator to said detector, said microprocessor being operatively connected to said digital voice recorder/playback means for initiating an announcement when a reflected signal of the given frequency is received at said detector.

2. The invention defined by claim 1 further including means for accumulating statistical data from said microprocessor.

3. A system for presenting automatic verbal announcements comprising:

a modulated infrared signal generator for generating a modulated signal of given frequency at a target when the target is within a sensing range;

a detector for detecting a modulated infrared signal of the given frequency after it is reflected from a target within the sensing range;

a digital voice recorder/playback means for recording an announcement and subsequently providing said announcement when a target is within the sensing range;

speaker means to provide an audible output in response to the announcement received from said digital voice recorder/playback means; and, a microprocessor operatively connected to said generator, said detector and said digital voice recorder/playback means to periodically output a modulated signal from said generator to said detector, receive said modulated signal from said detector, digitally time analyze said modulated signal to determine the presence of a target within said sensing range, and, in response thereto, initiate announcement from said digital voice recorder/playback means.

4. A system for presenting automatic verbal announcements comprising:

a modulated infrared signal generator having a variable output level for generating a modulated signal of given frequency at a target when the target is within a sensing range, said generator including an infrared emitter for emitting the signal, an oscillator/driver for modulating the signal, and a means to vary the output level of said generator;

a detector for detecting a modulated infrared signal of the given frequency after it is reflected from a target within the sensing range, said detector including an infrared detector for receiving a modulated signal of the given frequency reflected from a target when the target is within the sensing range, an amplifier for conditioning the reflected modulated signal of the given frequency and, a band pass filter for passing the reflected signal of the given frequency;

a digital voice recorder/playback means for recording an announcement and subsequently providing said announcement when a target is within the sensing range, said digital voice recorder/playback means including a digital voice recorder/playback unit, means for providing an audio input to said digital voice recorder/playback unit when said digital voice recorder/playback unit is in a recording mode and, means for storing said audio input as an announcement;

speaker means to provide an audible output in response to the announcement signals received from said digital voice recorder/playback unit when said digital voice recorder/playback unit is in a playback mode, said speaker means including a speaker, an amplifier, and, a volume control;

a microprocessor operatively connected to said oscillator/driver of said generator to periodically output a modulated signal from said emitter, said microprocessor being operatively connected to said digital voice recorder/playback unit for sending a start signal to said digital voice recorder/playback unit to initiate an announcement when a reflected signal is received at said detector band pass filter, said microprocessor receiving an announcement completion signal from said digital voice recorder/playback unit, said microprocessor adapted to send a parting announcement signal to said digital voice recorder/playback unit, to initiate a parting announcement;

means operatively connected to said microprocessor for switching said digital voice recorder/playback unit between play mode and record mode, means operatively connected to said microprocessor for switching said digital voice recorder/playback unit to record or initiate an announcement; and means operatively connected to said microprocessor for switching said digital voice recorder/playback unit to a parting announcement.

* * * * *